US007788835B2

(12) United States Patent
Venn

(10) Patent No.: US 7,788,835 B2
(45) Date of Patent: Sep. 7, 2010

(54) ADVERTISING DEVICE

(76) Inventor: Norman Clifford Venn, 89 Pitzer Road, Glen Austin (ZA) 1685

( * ) Notice: Subject to any disclaimer, the term of this patent is extended or adjusted under 35 U.S.C. 154(b) by 15 days.

(21) Appl. No.: 12/064,138

(22) PCT Filed: Aug. 11, 2006

(86) PCT No.: PCT/ZA2006/000098

§ 371 (c)(1),
(2), (4) Date: Feb. 19, 2008

(87) PCT Pub. No.: WO2007/022547

PCT Pub. Date: Feb. 22, 2007

(65) Prior Publication Data

US 2008/0236009 A1 Oct. 2, 2008

(30) Foreign Application Priority Data

Aug. 19, 2005 (ZA) ..... 2005/06649

(51) Int. Cl.
*G09F 17/00* (2006.01)

(52) U.S. Cl. ..... 40/604; 40/440

(58) Field of Classification Search ..... 40/604, 40/426, 440; 472/68

See application file for complete search history.

(56) References Cited

U.S. PATENT DOCUMENTS

| | | | | |
|---|---|---|---|---|
| 3,587,520 | A * | 6/1971 | Miller | 116/173 |
| 4,558,862 | A * | 12/1985 | Kelly | 473/176 |
| 5,145,132 | A * | 9/1992 | Kirschner | 248/59 |
| 6,266,904 | B1 | 7/2001 | Zheng | |
| 2001/0022153 | A1 | 9/2001 | Okumura et al. | |
| 2003/0029066 | A1 | 2/2003 | Venn | |
| 2005/0263061 | A1 * | 12/2005 | Llewellyn | 116/174 |

FOREIGN PATENT DOCUMENTS

| | | | |
|---|---|---|---|
| WO | 2004097118 | A2 | 11/2004 |
| ZA | 20038904 | A1 | 7/2004 |

* cited by examiner

*Primary Examiner*—Lesley Morris
*Assistant Examiner*—Kristina Staley
(74) *Attorney, Agent, or Firm*—Brooks Kushman P.C.

(57) ABSTRACT

The invention provides a device for advertising. The device includes a shaft to be vertically mounted, in use; an upper connection means proximate the upper end of the shaft for connecting to one end of each of at least two resiliently flexible rods; and a lower connection means proximate the lower end of the shaft for connecting to each other end of the resiliently flexible rods, such that with each rod being longer than the distance between the upper and lower connection means a banner of flexible material can, in use, be spanned by each rod in a plane defined by the rod and shaft.

14 Claims, 9 Drawing Sheets

Fig, 2

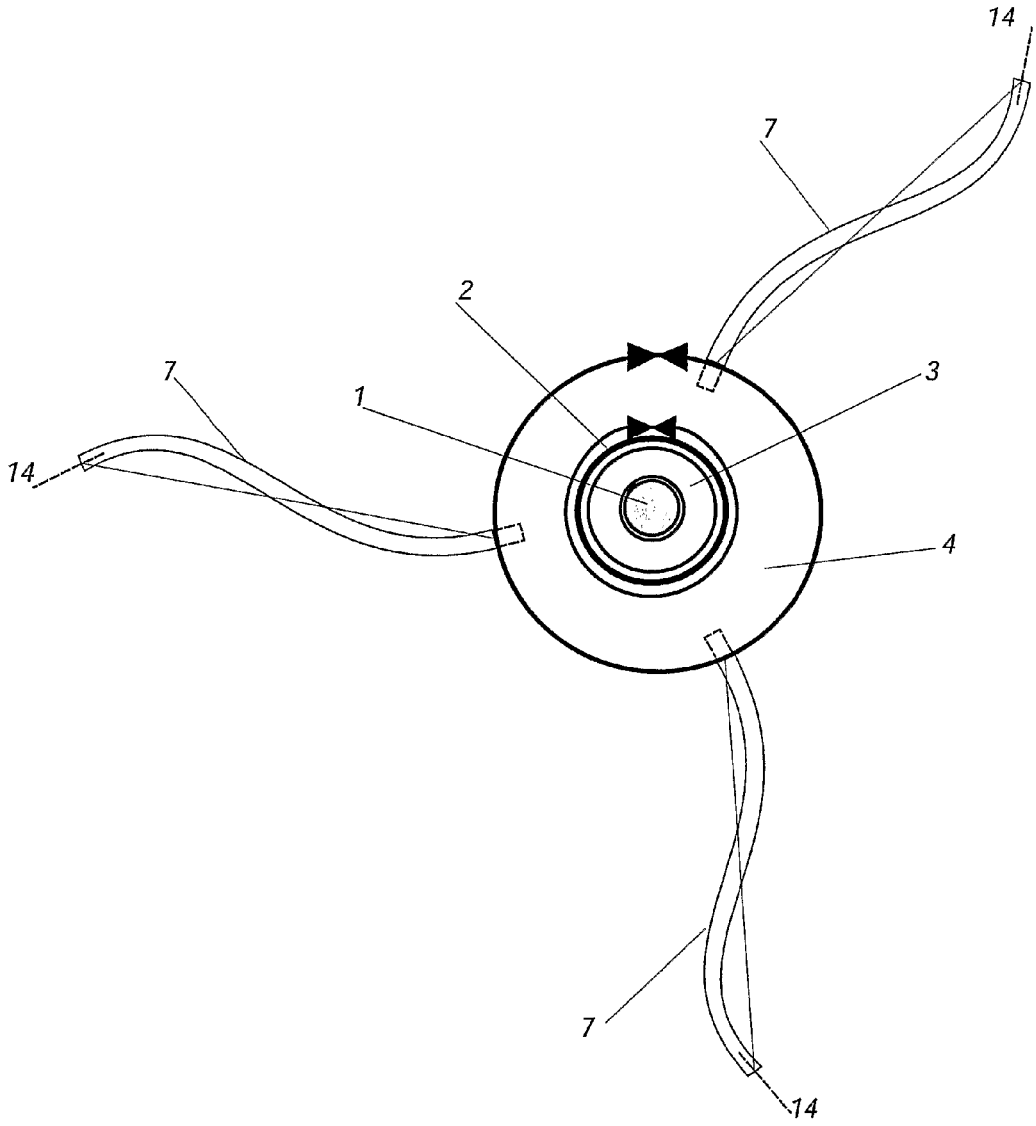
Fig, 13

ADVERTISING DEVICE

TECHNICAL FIELD OF THE INVENTION

This invention relates to a device for advertising.

BACKGROUND TO THE INVENTION

The applicant is aware that one dimensional advertising devices such as flags and banners are not visible from all angles. One way of making such one dimensional flags or banners visible is by causing them to rotate. Such a device is described in South African Patent 2003/8904 by the same applicant. It is an object of this invention to provide a further device for advertising, which addresses the problem of visibility.

GENERAL DESCRIPTION OF THE INVENTION

According to a first aspect of the invention there is provided a device for advertising, which device includes:

a shaft to be vertically mounted, in use;

an upper connection means proximate the upper end of the shaft for connecting to one end of each of at least two resiliently flexible rods; and a lower connection means proximate the lower end of the shaft for connecting to each other end of the resiliently flexible rods, such that with each rod being longer than the distance between the upper and lower connection means a banner of flexible material can, in use, be spanned by each rod in a plane defined by the rod and shaft.

The shaft may be configured to be rotatable to form an elongate spindle defining an upright axis for rotation.

The shaft may be of any shape or be virtual in the case where the resiliently flexible rods are configured to keep the upper and lower attachment means in the desired position without the use of a physical shaft.

The upper and lower connection means may preferably be configured to connect to three or four resiliently flexible rods to form a three dimensional projection view.

The shaft may be rotatably mountable on a mounting. The mounting may typically be a pole, base or a frame mountable on a pole or base.

The shaft and mounting may each be provided with a magnet, which magnets, in use, are axially aligned with corresponding poles of the magnets towards each other so as to oppose each other. It will be appreciated that at least some of the weight of the shaft and resiliently flexible poles is, in use, carried by the opposing magnetic forces to minimise rotation friction between the shaft and mounting.

The upper and lower connection means may be configured to have pairs of matching attachment points for attaching the resiliently flexible rod. The matching attachment points may be aligned or non-aligned in a plane radiating from the shaft. It will be appreciated that attachment of a resiliently flexible rod to non-aligned attachment points will warp the plane defined by the shaft and rod.

Alternatively, or in addition, the attachment points of the connection means may be configured to rotationally lock the rod in position. It will be appreciated that the resiliently flexible rod may then be torsionally pre-stressed so that the plane defined by the shaft and the rod may be warped.

Also, the resiliently flexible rods may be pre-formed or pre-shaped. In other words, the resiliently flexible rods may be biased on a predetermined shape.

It will be appreciated that the warp caused by non-aligned attachment points, predetermined shape, or tortional pre-stressing, or a combination thereof, can be predetermined so that a desired shape of the plane can be achieved. Typically the spanned banners, in use, can be shaped such that wind would rotate the device. In this way, a generally two dimensional device, i.e. with two spanned banners will rotate in a wind to increase visibility by appearing three dimensional and by adding movement. Additionally, a three dimensional device, i.e. having three or more spanned banners, can increase it visibility by adding rotational movement even in slight breezes.

The attachment points may be fixed sleeves provided in the upper and lower connection means for receiving an end of the flexible rods. Alternatively, the upper and/or lower connection means may be provided with a passage for receiving the vertical shaft axially slidably there through and the connection means is configured to allow the rods, when connected to be moveable in a generally vertical plane. In one embodiment, the connection means may include two or more a swivelable sleeves in a generally vertical slit defined in the connection means. In another embodiment, the connection means may be of a resiliently deformable material and include a horizontal slit about its periphery which widens on the inside thereof to accept a complementary widening portion provided at the end of a rod in a snap fit manner. The connection means is then further provided with a two or more spaced generally vertical slits to allow the rod vertical movement.

One of the connection means may be slidably moveable along the shaft, preferably the lower connection means and the moveable connection means and the shaft may be provided with complementary formations to lock the moveable connection means into position, preferably locked into a horizontal and vertical position. Typically the formations may be bayonet type or twist and lock type formations. It will be appreciated that the flexible rods can, in these embodiments, formed in an umbrella like fashion.

It will further be appreciated that the device should be constructed from light materials, which also lowers the rotational friction.

It will also be appreciated that the device can easily be transported in its disassembled form, easily assembled on site in a variety of shapes using a banner with printed matter.

The resiliently flexible rods may be of metal such as aluminum, composite material such as fibre glass or graphite, or any other suitable material.

The device may include a banner configured to attach a resiliently flexible rod thereto along an edge of the banner. Typically the banner may be provided with a sleeve for receiving the rod there through.

DETAILED DESCRIPTION OF THE INVENTION

The invention is now described by way of example with reference to the accompanying drawings.

In the drawings:

FIG. 13 shows diagrammatically a side view of a further embodiment of the advertising device, in accordance with the invention.

Figure 1:
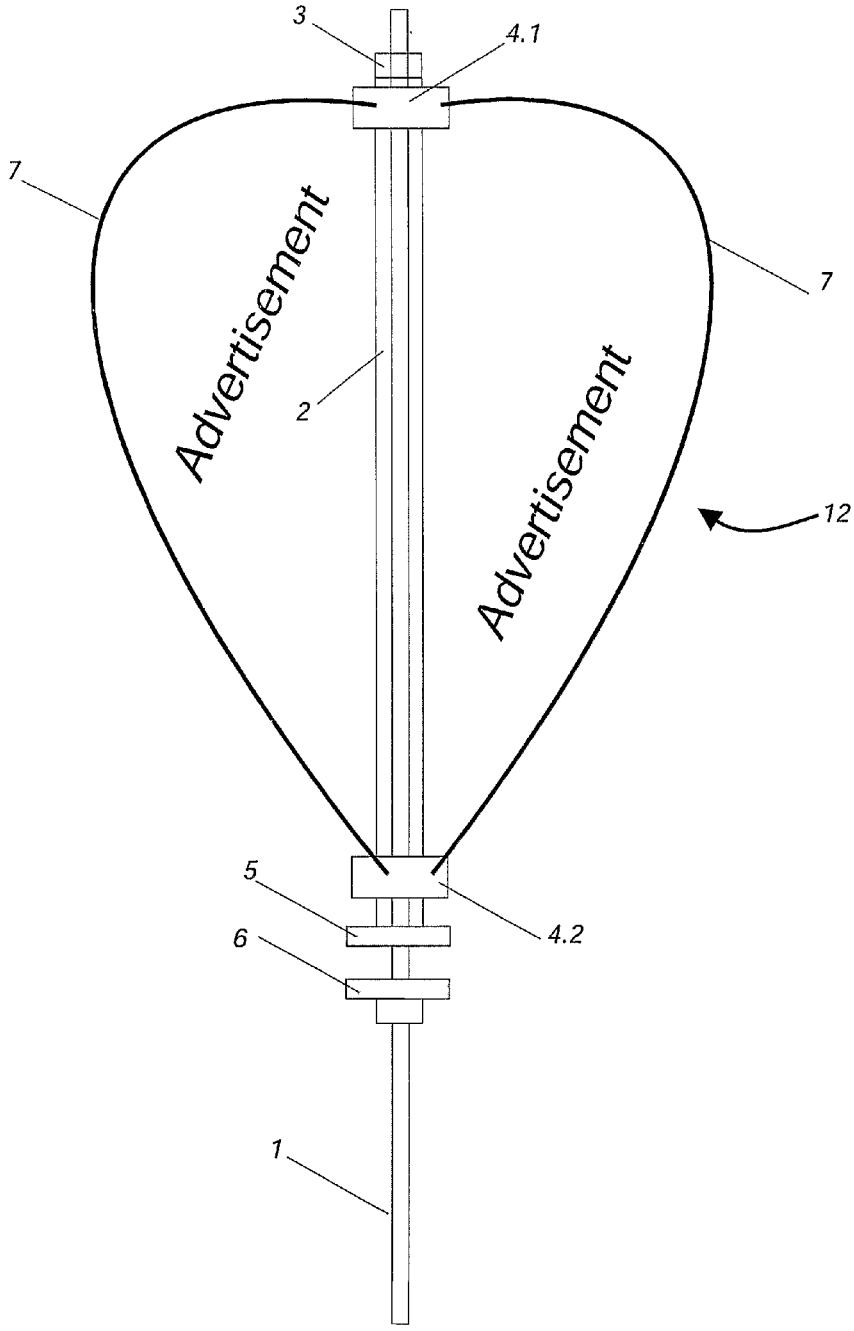
FIG. 1 shows diagrammatically a side view of the advertising device, in accordance with the invention.
Figure 2:
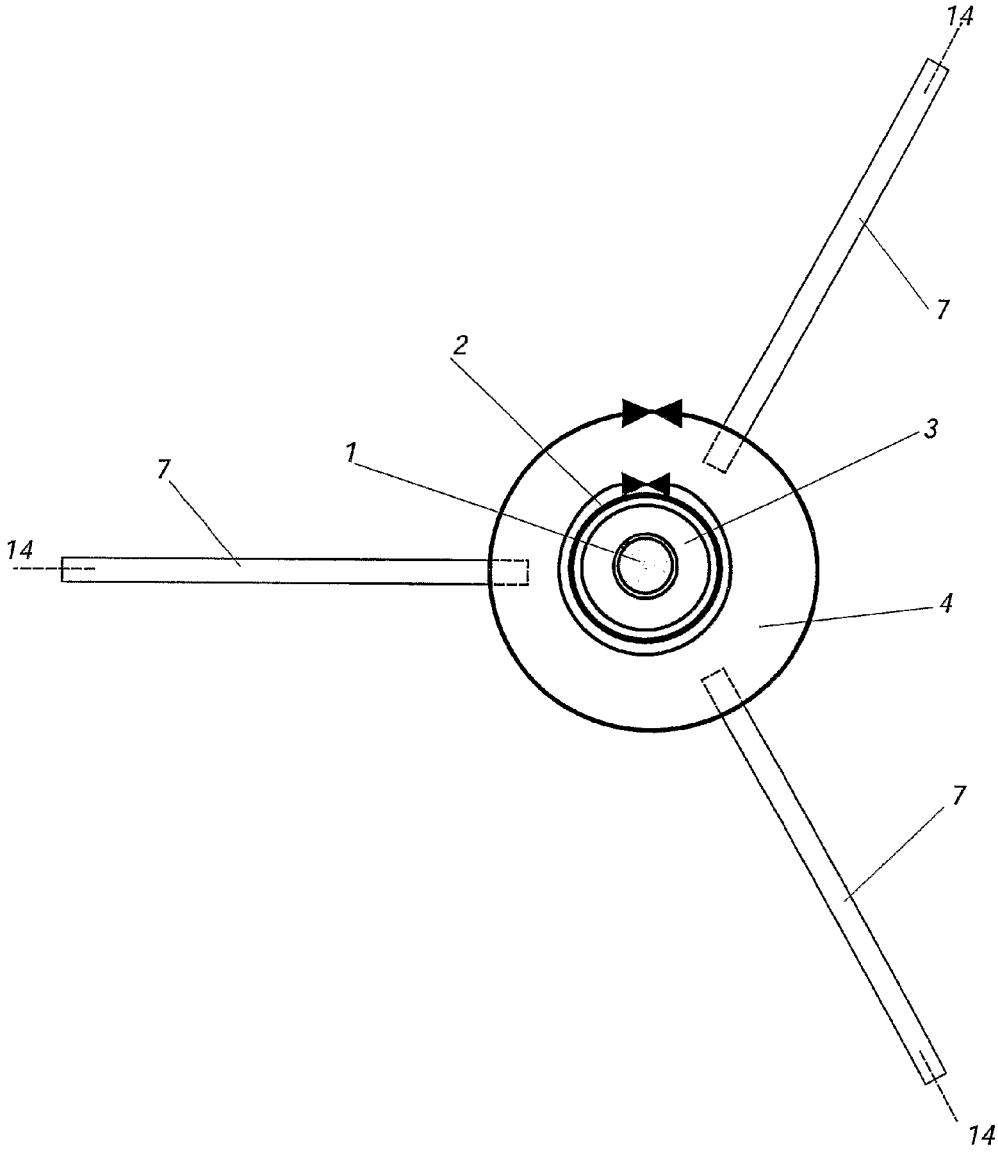
FIG. 2 shows diagrammatically a plan view of the advertising device.
Figure 3:
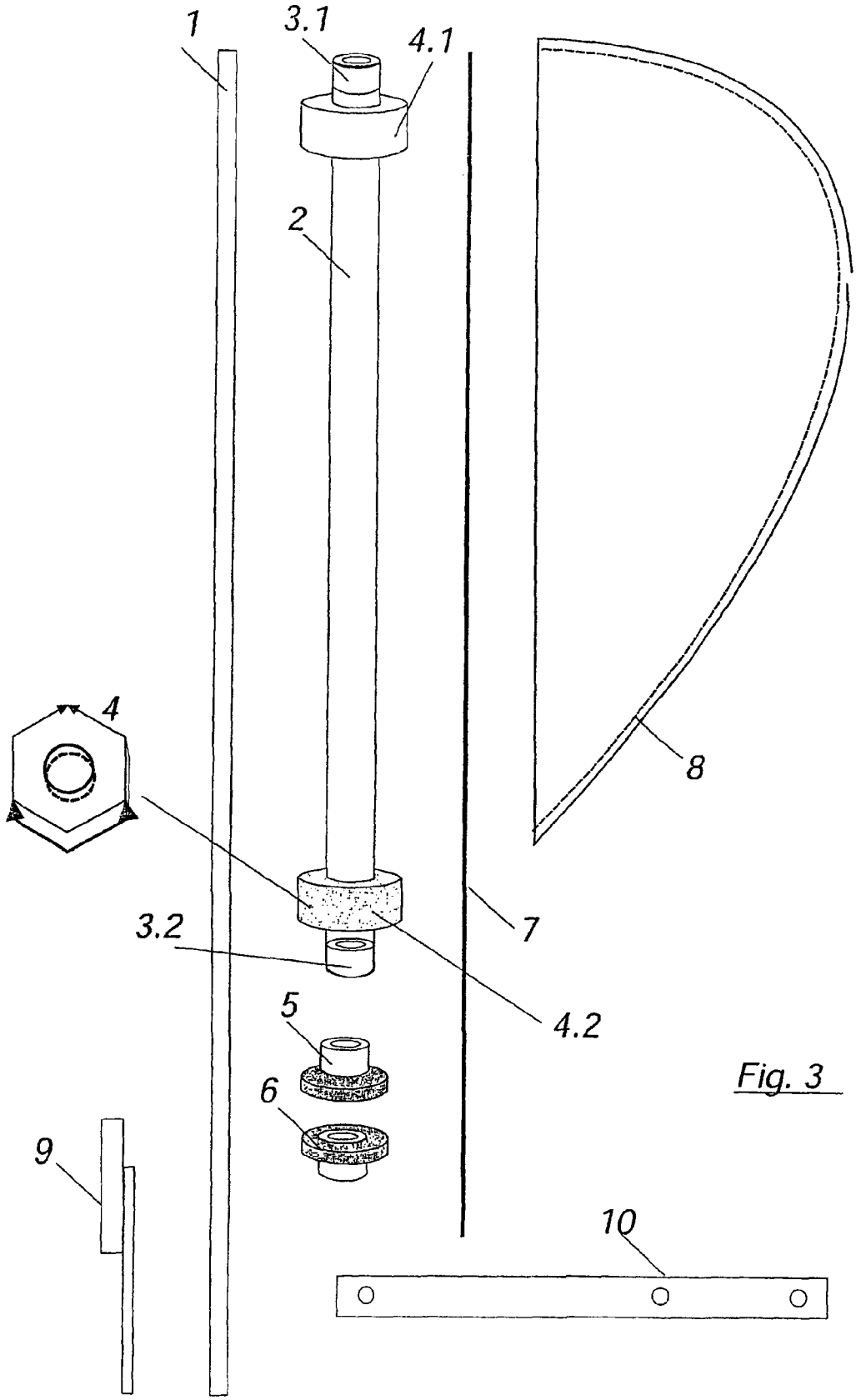
FIG. 3 shows diagrammatically an exploded view of the advertising device.

Referring now to the drawings, the advertising device, in accordance with the invention, is generally indicated by reference numeral 12.

The device 12 device for advertising includes a shaft 2 to be vertically mounted, in use over a pole 1. The device 12 further includes an upper connection means 4.1 proximate the upper end of the shaft 2 for connecting to one end of each of three resiliently flexible composite rods 7, and a lower connection means 4.2 proximate the lower end of the shaft 2 for connecting to each other end of the resiliently flexible rods 7. Each rod 7 is longer than the distance between the upper 4.1 and lower 4.2 connection means and a banner 8 of flexible material can, in use, be spanned by each rod 7 in a plane 14 defined by the rod 7 and shaft 2 to form a three dimensional projection view.

The upper 4.1 and lower 4.2 connection means are configured to have pairs of aligned matching attachment points for attaching the resiliently flexible rods 7.

Figure 5:
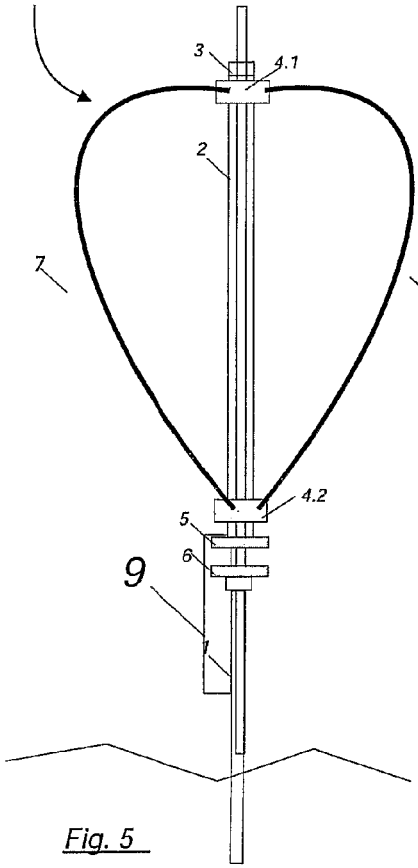
FIGS. 5 to 9 shows diagrammatically different mounting means for the advertising device, in accordance with the invention.
Figure 6:
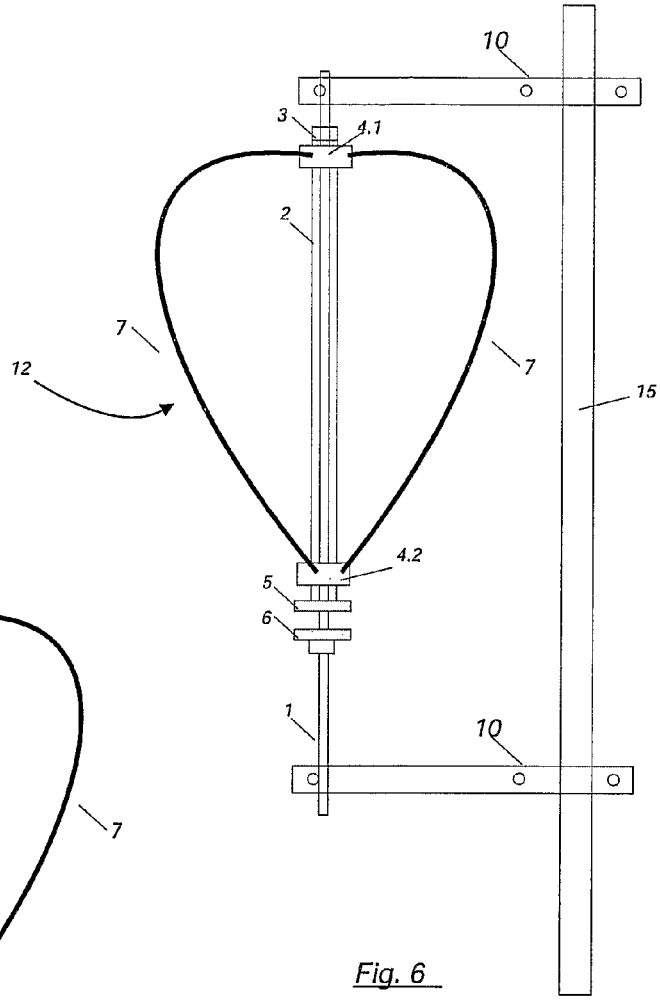
Figure 7:
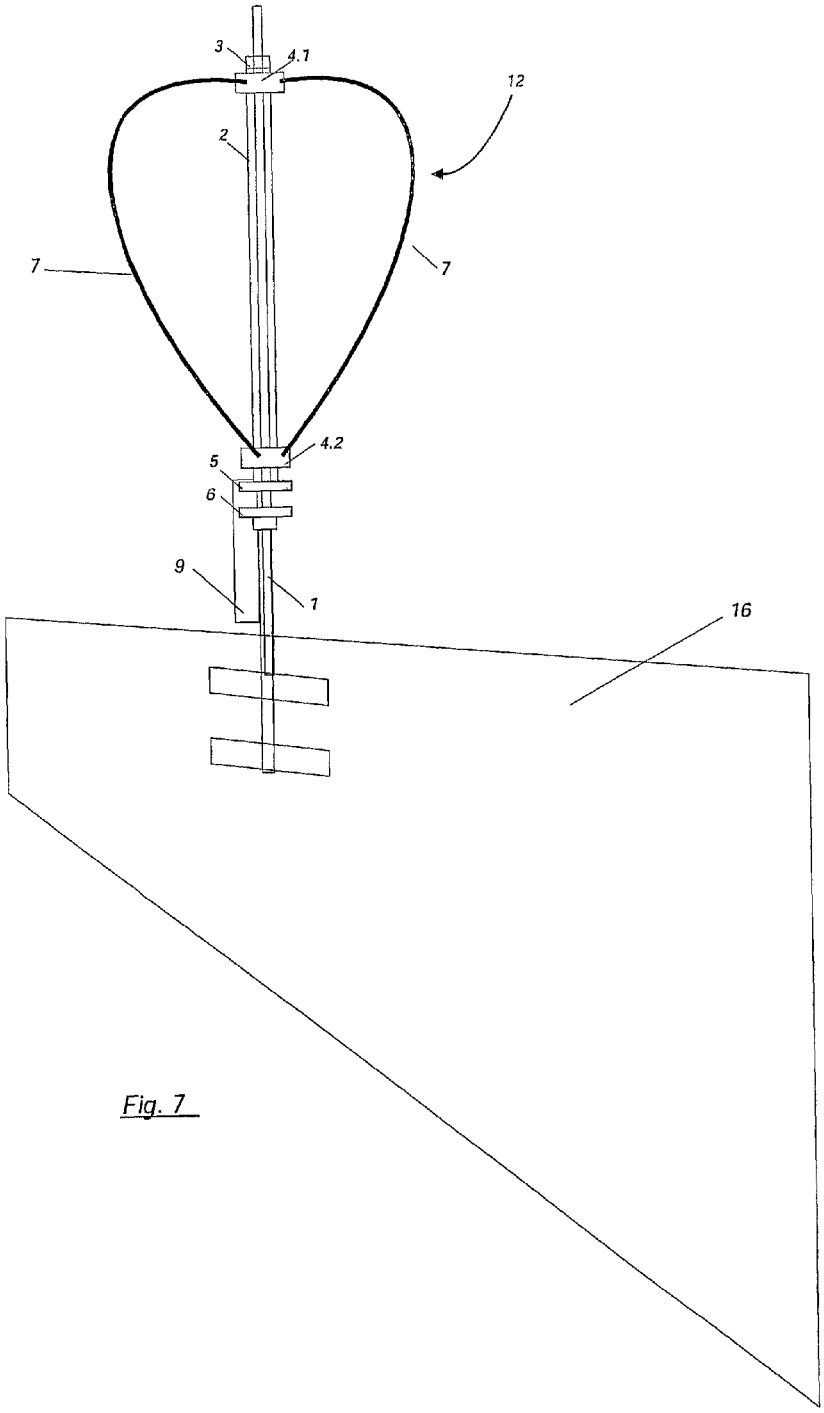
Figure 8:
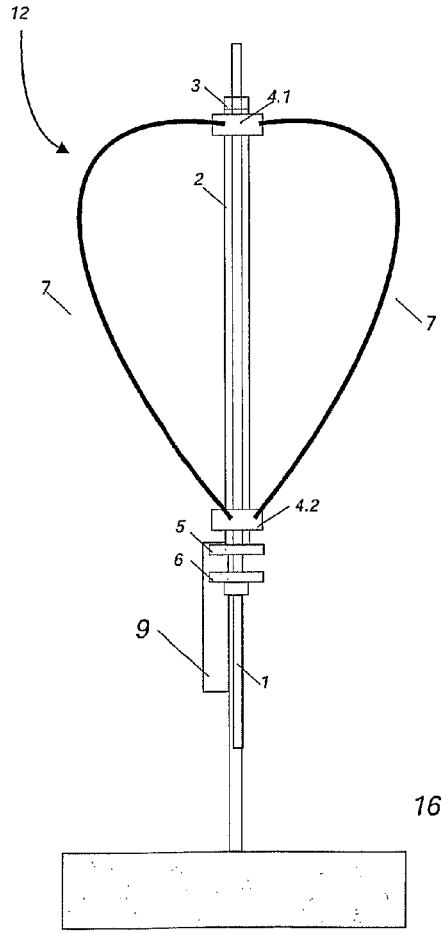
Figure 9:
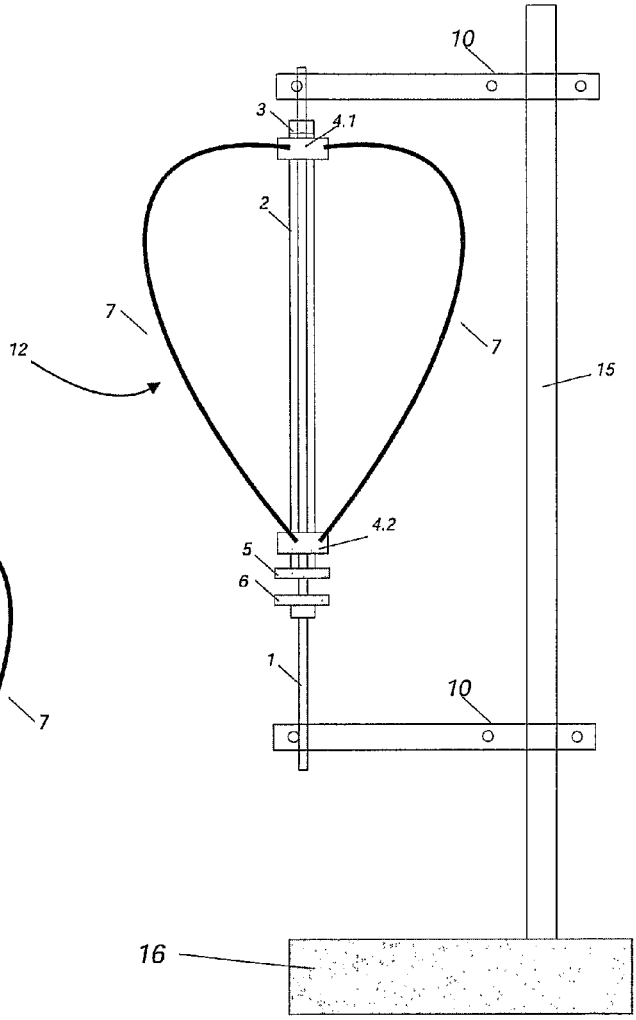

The shaft 2 is configured to be rotatable to form an elongate spindle defining an upright axis for rotation. The shaft is rotatably mounted on a mounting in the form of a pole 1. The mounting can be selected from a Ground spike 9 (FIG. 5); brackets 10 (FIG. 6) for mounting to a fixed pole 15, a wall or fence 16 (FIG. 7); or a base in combination with a spike 9 (FIG. 8) or brackets 10 (FIG. 9) or mountable on a pole or base.

The shaft 2 and pole 1 are each provided with a magnet 5 and 6, respectively, which magnets, in use, are axially aligned with corresponding poles of the magnets towards each other so as to oppose each other.

In another embodiment of the invention, as shown in FIG. 13, the spanned banners 8, in use, are be shaped such that wind would rotate the device.

The banner 8 is of a printable canvas and is provided with a sleeve 17 for receiving the rod 7 there through.

Figure 10:
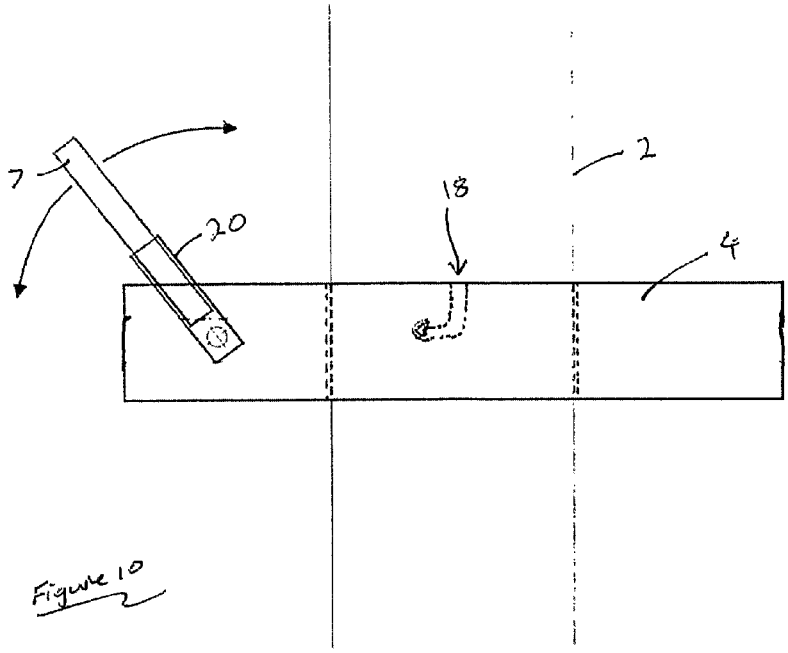
FIGS. 10 and 11 shows diagrammatically, in side view, different embodiments of the attachment means, in accordance with the invention.
Figure 11:
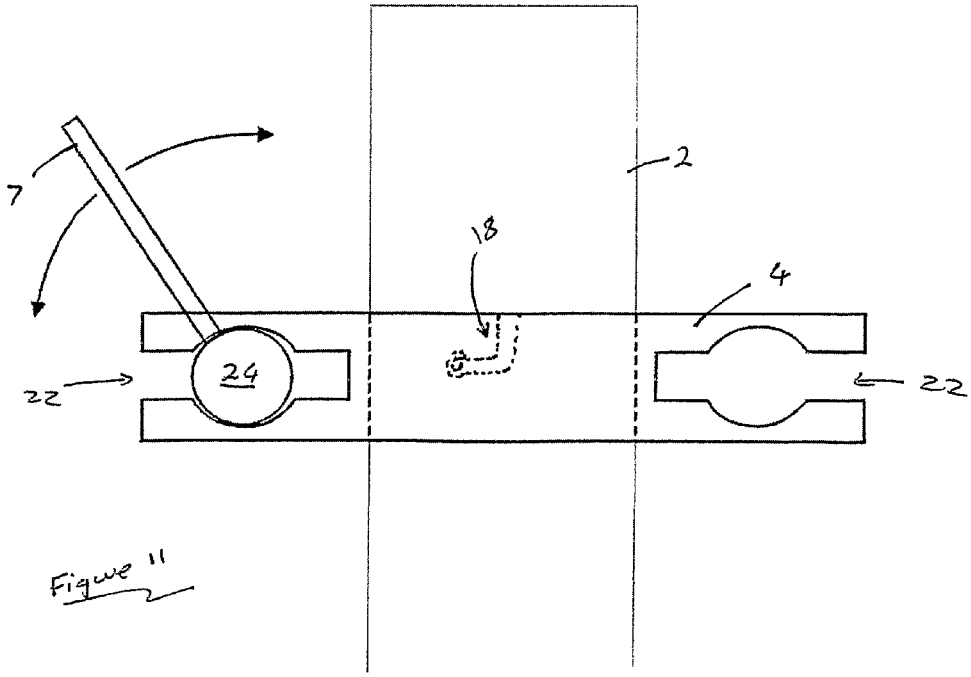
Figure 12:
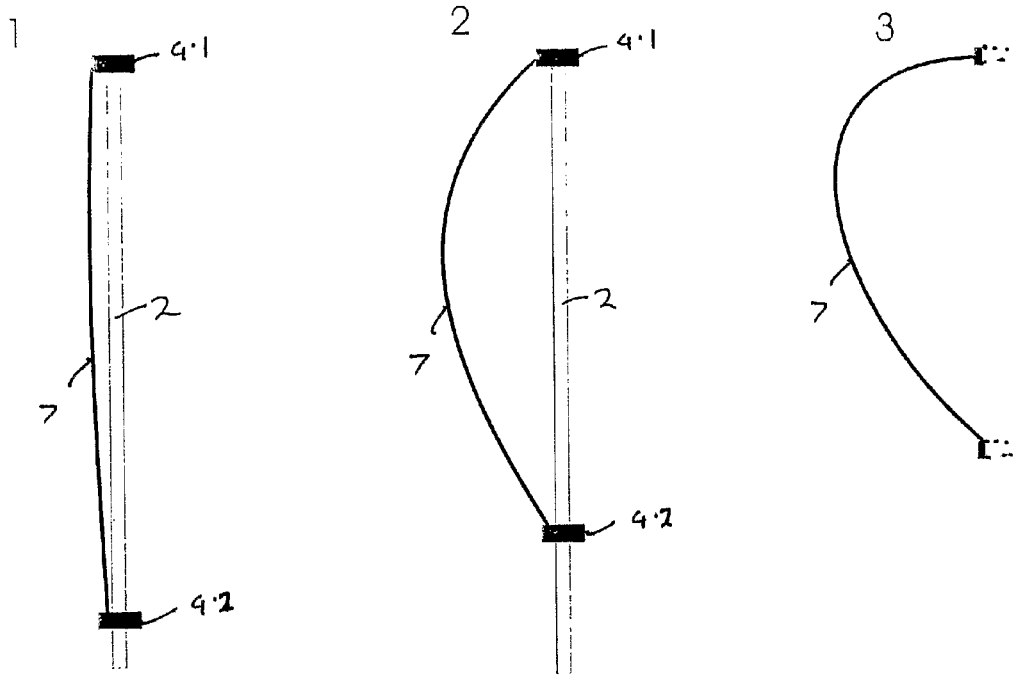
FIG. 12 shows diagrammatically the working of another embodiment of the device for advertising.

In other embodiments, shown in FIGS. 10 and 11, the lower connection means may be provided with a passage for receiving the vertical shaft 2 axially slidably there through and the connection means is configured to allow the rods 7, when connected to be moveable in a generally vertical plane. The moveable connection means 4.1 and the shaft are be provided with complementary bayonet type formations 18 to lock the moveable connection means into position in an umbrella like fashion as shown in FIG. 12.

In the embodiment shown in FIG. 10, the connection means include three swivelable sleeves 20 in a generally vertical slit defined in the attachment means 4.1. In another embodiment shown in FIG. 11, the connection means 4.1 is manufactured of a resiliently deformable plastics material and includes a horizontal slit 22 about its periphery which widens on the inside thereof to accept a complementary widening portion 24 provided at the end of a rod 7 in a snap fit manner. The connection means is then further provided with three spaced generally vertical slits to allow the rod 7 vertical movement.

It shall be understood that the examples are provided for illustrating the invention further and to assist a person skilled in the art with understanding the invention and are not meant to be construed as unduly limiting the reasonable scope of the invention.

The invention claimed is:

1. A device for advertising, which device comprises:

a shaft to rotatably and be vertically mounted, in use;

at least three resiliently flexible rods;

an upper connection means proximate the upper end of a shaft for connecting the shaft to one end of each of the at least three resiliently flexible rods;

a lower connection means proximate a lower end of the shaft for connecting the shaft to each other end of the resiliently flexible rods, such that with each rod being longer than the distance between the upper and lower connection deforms in a bow shape so that a banner of flexible material can, be supported by each rod in a region defined by the rod and shaft wherein the upper and lower connection means are configured to connect to at least three flexible rods;

wherein the shaft is rotatably mountable on a mounting to form an elongate spindle defining an upright axis for rotation; and wherein the upper and lower connection means are configured to have pairs of matching attachment points for attaching a resiliently flexible rod, which matching points can be locked in a vertically non aligned position to each other so that the surface defined by the shaft and each resiliently flexible rod is a warped plane.

2. A device as claimed in claim 1, wherein the shaft and mounting each comprise a magnet fixed thereto, which magnets, in use, are axially aligned with corresponding poles of the magnets towards each other so as to oppose each other.

3. A device as claimed in claim 1, wherein one of the connection means are configured to rotate about the shaft and rotationally lock in position so that the resiliently flexible rods are biased toward a predetermined non-planer shape.

4. A device as claimed in claim 3, wherein the attachment points of the connection means are configured to rotationally lock a resiliently flexible rod in position.

5. A device as claimed in claim 1, wherein the attachment points of the connection means are configured to rotationally lock a resiliently flexible rod in position.

6. A device as claimed in claim 1, wherein each pair of matching attachment points are not aligned in a plane radiating from the shaft so that the resiliently flexible rod is biased toward a predetermined shape to warp the surface of a banner supported by the shaft and each resiliently flexible rod.

7. A device as claimed in claim 6, wherein the resiliently flexible rod is biased toward a predetermined shape.

8. A device as claimed in claim 1, which device is configured to rotate in a wind.

9. A device as claimed in claim 1, which device includes a banner configured to attach a resiliently flexible rod thereto along an edge of the banner.

10. A device as claimed in claim 1, wherein one of the connection means is provided with a passage for receiving the vertical shaft axially slidably there through and the connection means is configured to allow the rods, when connected to be moveable in a generally vertical plane.

11. A device as claimed in claim 10, wherein the connection means includes two or more swivelable sleeves for receiving an end of a rod.

12. A device as claimed in claim 10, wherein the connection means is of a resiliently deformable material and includes:

a horizontal slit about it's a periphery of the connection means which widens on the inside thereof to accept a complementary widening portion provided at the end of a rod in a snap fit manner; and two or more spaced generally vertical slits to allow the rod vertical movement.

13. A device as claimed in claim 10, wherein the moveable connection means and the shaft includes complementary formations to lock the moveable connection means into predetermined position.

14. device as claimed in any one of claim 1, wherein the upper and lower connection means are configured to connect to at least three flexible rods to form a three dimensional projection view.

* * * * *

UNITED STATES PATENT AND TRADEMARK OFFICE

CERTIFICATE OF CORRECTION

PATENT NO. : 7,788,835 B2
APPLICATION NO. : 12/064138
DATED : September 7, 2010
INVENTOR(S) : Norman Clifford Venn It is certified that error appears in the above-identified patent and that said Letters Patent is hereby corrected as shown below:

Column 4, Line 64, Claim 12:

Delete "it's" before "a periphery".

Column 5, Line 5, Claim 13:

After "into" insert -- a --.

Column 6, Line 1, Claim 14:

After "14" and before "device" insert -- A --.

Column 6, Line 1, Claim 14:

After "as claimed in" delete "any one of".

Signed and Sealed this
Twenty-eighth Day of December, 2010

David J. Kappos

David J. Kappos
*Director of the United States Patent and Trademark Office*